United States Patent [19]

Stoppazzini

[11] Patent Number: 4,686,838

[45] Date of Patent: Aug. 18, 1987

[54] DEVICE FOR REGULATING THE STITCH DENSITY OR AUTOMATIC FLAT KNITTING MACHINES

[75] Inventor: Benito Stoppazzini, Sala Bolognese, Italy

[73] Assignee: E.M.M. Emiliana Macchine Maglieria S.R.L., Bologna, Italy

[21] Appl. No.: 895,683

[22] Filed: Aug. 12, 1986

[30] Foreign Application Priority Data

Sep. 18, 1985 [IT] Italy ..... 3552 A/85

[51] Int. Cl.[4] ..... D04B 7/00

[52] U.S. Cl. ..... 66/71; 66/77

[58] Field of Search ..... 66/77, 71, 78

[56] References Cited

U.S. PATENT DOCUMENTS

| | | | |
|---|---|---|---|
| 2,183,719 | 12/1939 | Lippman et al. | 66/71 |
| 4,004,437 | 1/1977 | Schieber et al. | 66/77 X |
| 4,502,300 | 3/1985 | Schimko et al. | 66/77 X |
| 4,510,775 | 4/1985 | Shima | 66/77 |
| 4,554,802 | 11/1985 | Goller et al. | 66/77 X |

*Primary Examiner*—Ronald Feldbaum

*Attorney, Agent, or Firm*—Stevens, Davis, Miller & Mosher

[57] ABSTRACT

A device is designed to operate two slides to which corresponding stitch regulation cams are bound, and it includes: a plate, mounted on the carriage and located below the slides, that is able to be moved by means in relation to the carriage in the direction in which this latter is itself moved, two tracks, symmetrical in relation to a vertical plane, formed in the upper part of the plate, each constituted by flat horizontal surface and by a flat surface that follows on and inwards from the former, turning downwards, elastic means which keep the extremities of the slides in contact with the corresponding tracks.

Movement of the plate in one direction causes the slide which is downstream in respect of the direction of movement to be lowered in proportion to the amount by which the former is moved.

4 Claims, 3 Drawing Figures

DEVICE FOR REGULATING THE STITCH DENSITY OR AUTOMATIC FLAT KNITTING MACHINES

BACKGROUND OF THE INVENTION

The invention relates to a device for regulating the stitch density of automatic flat knitting machines.

DESCRIPTION OF THE PRIOR ART

It is known that the needle bed on automatic flat knitting machines is equipped with equidistant slots perpendicular to the carriage's direction of movement.

Proceeding from above to below, each slot, in order, has located within it a needle (featuring a heel on its lower part) and a sinker the purpose of which is, when being shifted, to drive the aforementioned needle.

The sinker's movement consists in being raised upwards a first time, (operated by means for shifting it carried on the carriage, and acting on the sinker), followed by a second movement consequent upon cams, integral with the carriage, moving against corresponding heels formed on the sinker; further fixed cams, positioned below the preceding ones, serve the purpose of returning the sinker to the rest position.

Raising of the sinker beyond a predetermined value brings about the movement of the needle in the same direction, the heel of which consequently makes contact with related cams, the purpose of which is to set the needle in operation (outward stroke), either to make a stitch, or to trasfer a stitch to or from another needle bed, or for a so-called carry-over stitch.

It is known that the length of the return stroke, before the latter is again returned to the initial rest position, determines the density of the knitted fabric (or "fineness" of the knitted fabric); more accurately, the density of the knitted fabric diminishes with the increase in value of the said length.

The return stroke of the needle is consequent upon the heel of the needle coming into contact with a stitch density control cam that is inclined and carried on a slide which is integral with the carriage.

Since the carriage operates in both directions, there are two symetrical control cams located in a plane perpendicular to the direction of the carriage's movement.

It is known that the operational control cam is that which is situated further down the carriage for a given direction of travel; the said cam is, each time it comes into contact with the heel of the needle, subject to both the elastic reaction of the taut knitting yarn, hooked by the latch of the needle, and by a "hammering" action due to the impact of the cam against the heel, as well as by the separation of this latter from the cam itself.

The forces involved above (which increase with an increase in the tautness of the yarn being knitted, and which reach a maximum value coinciding with the lowest position of the adjustment cam), rebound upon the control device for the slides carrying the aforementioned adjustment cams, a device necessary precisely to control the length of the return stroke of the needle.

In a known device the slides are equipped with racks that both engage with the same pinion, itself keyed to a motor of, for example, the step-by-step type.

In this solution the forces acting upon the slides rebound directly upon the motor drive shaft with all the disadvantages this brings; furthermore "lowering" of the selected cam (that which strikes the heel of the needle) brings about the "lifting" of the other cam: this compels the maker to include a free zone above the cams when in their at rest position in order to take these "lifts" into account.

All in all, the above solution is questionable from a functional point of view, in that the two slides are not independent of one another.

In the German Pat. No. 053344667 (of the Shima Idea Center, Japan), a device is illustrated in which the adjustment of each slide is effected through the beating of a striker formed in the latter against a lever arm, this movement being caused by a spring acting on the same slide; rotation of the lever, and therefore the lifting or lowering of the aforementioned lever arm, is effected by an electric motor operating through cams and levers; the slide which has not been selected is prevented from lowering (that is to say it is kept in the at rest position) in consequence of its striking against a horizontal rod, mobile along its axis, and mounted below the former in phase with the selection of the other slide.

The above-mentioned device is particularly complex; furthermore, the forces acting on the slide selected are opposed by the spring in inverse proportion to the degree to which the slide is "lowered", whilst, as is known concerning the aforementioned "lowering", when the length of the return stroke of the needle increases, it causes a corresponding increase in the tension of the thread and thus also in the mechanical forces applied by the heel of the needle to the slide, forces which tend, in opposition to the spring, to raise the slide itself.

SUMMARY OF THE INVENTION

The object of the invention is to propose a device with which to operate the stitch density adjustment cams independantly of one another, with the device itself operating in such a manner as not to transmit to the driveshaft of the respective motor the mechanical forces applied by the heel of the needle to the adjustment cam selected, and also to oppose the said forces with increasing effectiveness as this latter increases.

Another object of the invention is to propose a device that is simple to produce, and very reliable, needing only limited maintenance.

The aforementioned features are obtained by using a stitch density device for automatic flat knitting machines, that is situated in the carriage of such a machine and includes two stitch density adjustment cams, integral with the same number of slides, where the two slide and cam pairs are located symmetrically in a plane perpendicular to that in which the aforesaid carriage is moved, and where the cam that is situated further down the carriage for a given direction of travel is destined to strike the heels of the needles sent into operation, consequently determining the length of the return stroke of the needles themselves; the said device being characterized by the fact that it includes: a plate situated below the lower extremities of the said two slides, sliding in the direction of movement of the said carriage, and enabled to move in both directions, with respect to this latter, by motorizing means; two tracks, symmetrically situated with respect to the aforementioned perpendicular plane, being formed in the said plate, serving for the sliding of and as stop for the corresponding lower extremities of the said slides, that maintain contact with the relevant tracks through the action of elastic means acting on the aforementioned slides, with each track being composed of a flat surface, parallel to the aforesaid direction of movement of the carriage, and by an inclined surface, following on from the former towards the inside of the plate, the said flat and inclined surfaces respectively determining the at rest position of the relevant slide, and a lowered position that is adjustable with respect to the at rest position according to the movement of the plate in a corresponding direction.

BRIEF DESCRIPTION OF THE DRAWINGS

The characteristics of the invention that do not emerge from what has been stated above are emphasized hereinafter with close reference to the single accompanying table of drawings in which.

DESCRIPTION OF THE PREFERRED EMBODIMENT

Figure 1:
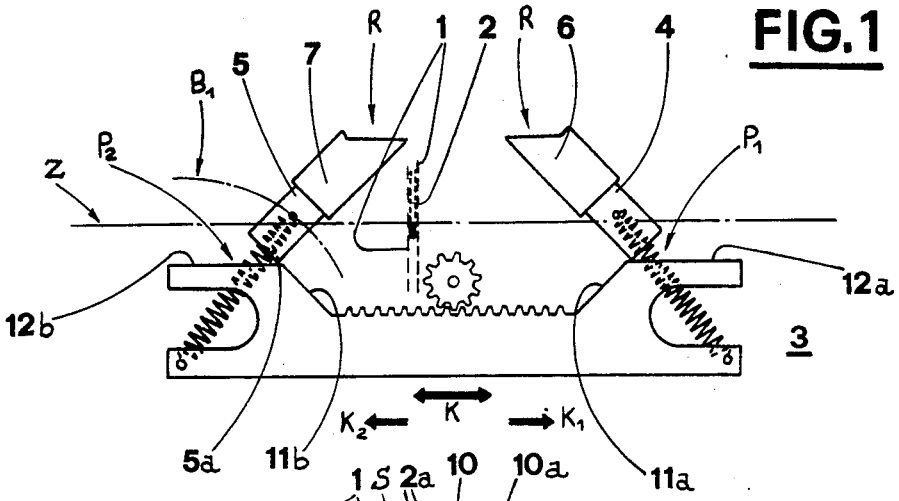
FIG. 1 shows, diagrammatically, a front view of the device with the two stitch density adjustment cams in the at rest position.

With reference to the said figures, shown at 1 by dotted lines are several slots formed in the needle bed of a flat knitting machine, and shown at 2, also by dotted lines, are the needles located in the upper part of the said slots; the sinkers located in the central portion of the lower part of each slot have not been illustrated in that they do not pertain to the invention; the purpose of the said sinkers is, when selected, to set the corresponding needles in operation; the means for selecting the sinkers are positioned, as is known, within the carriage shown in outline at 3, and not illustrated in detail.

The aforementioned carriage supports slides 4 and 5, upon which stitch density adjustment cams 6 and 7 respectively are stopped; the two slide and cam pairs are located symmetrically in relation to a plane perpendicular to that of the direction K in which the aforesaid carriage 3 is moved, diverging between their upper and lower extremities.

Beneath the lower extremities 4*a* and 5*a* of the slides a plate 8 is located, mounted on the carriage and able to slide, in relation to the latter, in direction K. A rack 9 is formed in the central portion of the upper part of the plate which engages with a pinion 10 keyed onto the shaft 10*a* of a step-by-step motor that is not illustrated; in this way it is possible to move the plate in relation to the carriage, in both directions K1 and K2 in preset increments of distance ("steps"). The upper part of the plate features two inclined flat surfaces 11*a* and 11*b* on either side of the rack 9, that diverge symmetrically with respect to the above-mentioned surface; the upper part of the plate also features two horizontal flat surfaces 12*a* and 12*b* which follow on from surfaces 11*a* and 11*b* respectively, complanate with each other, and parallel to the previously mentioned direction K.

The pairs of flat and inclined surfaces constitute tracks P1 and P2.

To slits 4 and 5 are hooked the ends of springs 13*a* and 13*b* respectively, the other ends of which are attached to the plate 8: the positions of the slides, springs and plate relative to one another will be detailed hereinafter.

The action of the springs 13*a* and 13*b* keeps the extremities 4*a* and 5*a* of the slides in contact with the tracks P1 and P2 respectively.

In at rest conditions the plate 8 is positioned symmetrically in respect to the plane, perpendicular to K, along the axis of which runs shaft 10*a* (FIG. 1); in this situation the extremities 4*a* and 5*a* of the slides are in contact with surfaces 12*a* and 12*b*: this defines the at rest position R of the cams 4 and 5 (FIG. 1).

The situation described immediately above is effected by the programmed control unit (not illustrated), which controls the step-by-step motor when the needles 2 are not set in operation: in this case the heels 2*a* of the needles pass through trajectory Z in relation to the carriage (FIG. 1).

Let us now examine the case in which the needles are set in operation, supposing the carriage to be moving in direction K1; in this situation varying the length of the return stroke of the needle from the operating position, one adjusts the density (or "fineness") of the knitted fabric. The needle returns as a consequence of being struck by the internal surface S of the adjustment cam which is further down the carriage when it is being moved in the direction K1: in the example under consideration the surface S relates to cam 7. Adjustment of the said density is, in the case being illustrated, effected by turning the pinion 10 in direction N for the preset number of "steps"; the consequent movement in direction K2 of the plate 8 causes the extremity 5*a* of the slide 5 to slide along track P2; the said extremity thus gradually comes into contact with the inclined surface 11*b*, bringing about, through the action of the spring 13*b*, the gradual lowering of the slide 5: the amount by which it is thus lowered is proportional to the number of "steps" effected by the step-by-step motor.

Figure 2:
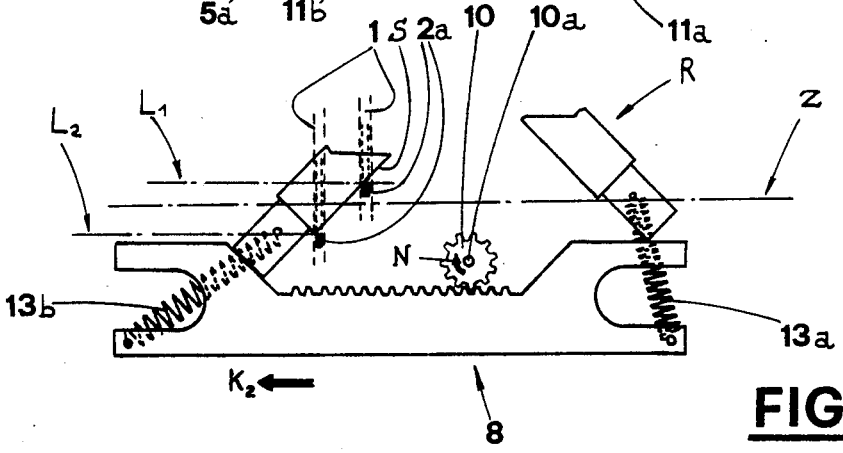
FIGS. 2 and 3 show the device in FIG. 1 in two configurations relating to two different setting positions for one of the above-mentioned cams.

As a consequence of the movement of the carriage in direction K1, the surface S of the cam 7 strikes the heel 2*a* of the needles in operation; the said heel is lowered from position L1 to position L2: further fixed cams, not illustrated, carry the heel along trajectory Z (FIG. 2).

Figure 3:
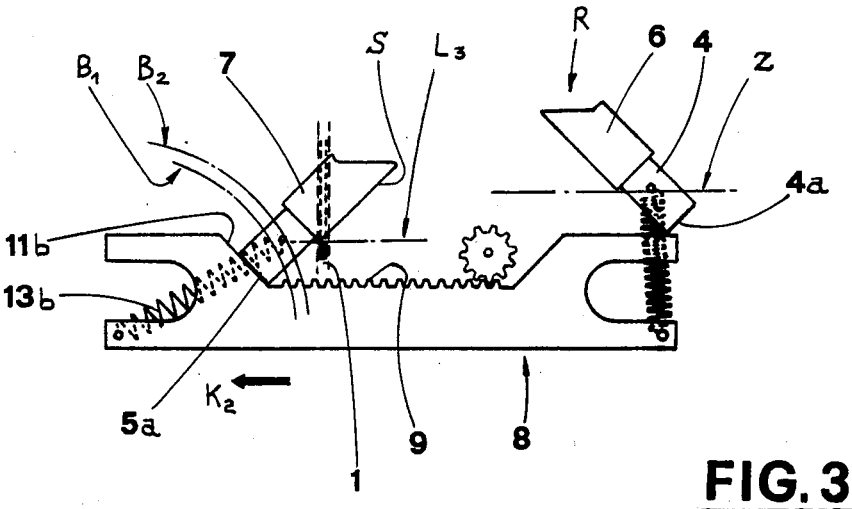

The lowest position of the heel 2*a*, position L3, is obtained when the slide 5 is in the position shown in FIG. 3.

When the carriage is moving in direction K2, the cam 6 is selected in exactly the same manner as has been described for the cam 7.

The springs 13*a* and 13*b* are attached to the plate 8 in such a way that their elongation, and thus their elastic reaction, increases as the corresponding extremities 4*a* and 5*a* of the slides to which they are hooked slide from the flat surfaces 12*a* and 12*b* to the inclined ones 11*a* and 11*b*: this has been shown in FIG. 3 by the arcs B1 and B2.

The mechanical forces transmitted by the heel 2*a* to, for example, the cam 5 (and tending to raise the cam itself), increase in intensity, as is known, when there is an increase in the tension with which the yarn is hooked by the needle latch, that is to say when there is an increase in the length of the return stroke of the needle itself; the said forces are effectively opposed by the spring under traction in that the elastic reaction of this latter progressively increases with the gradual lowering of the cam to which the same spring is hooked.

The aforementioned mechanical forces are primarily opposed by the springs 13*a* and 13*b*, and secondarily by the plate 8; the pinion 10, and respective shaft 10*a*, are not subject to nor influenced by these same forces.

In conclusion, the device operates the cams 6 and 7 independantly, (furthermore it should be emphasized that the aforementioned cams do not rise from their at rest position), enables the mechanical forces to be opposed with gradually increasing effectiveness as these forces themselves increase, and, finally, is designed such that the above-mentioned forces are not transmitted to the shaft 10*a* of the step-by-step motor.

Simplicity of construction, effectiveness, and compact design are further advantageous aspects of the design under consideration.

It is understood that the description given herein is purely an unlimited example, and thus that eventual variations of a nature regarding its practical application, (such as, for example, that the inclined surfaces 11*a* and 11*b* could be curved instead of flat), are understood as being covered by the description and following claims of the above technical solution.

What is claimed is:

1. A device for regulating the stitch density of automatic flat knitting machines, that is situated in a carriage of such a machine and includes two stitch density adjustment cams, integral with a same number of slides, wherein two slide and cam pairs are located symmetrically with respect to a plane perpendicular to that of movement of said carriage, and wherein the cam that is located downstream in respect of a given direction of movement of the carriage is destined to strike corresponding heels made on needles sent into operation, consequently determining the length of the return stroke of said needles themselves; and device including: a plate situated below lower extremities of said two slides, sliding in the direction of movement of said carriage, and enabled to move in both directions, with respect to this latter, by moving means; two tracks symmetrical to said plane perpendicular to the direction of movement being formed in said plate, serving for the sliding of and as stop for said corresponding lower extremities of said slides, these latter maintaining contact with said relevant tracks through the action of elastic means acting on the said slides; with each track being composed of a flat surface, parallel to said direction of movement of said carriage, and an inclined surface following on from the former towards the inside of said plate, said flat and inclined surfaces respectively determining said relevant slide's at rest position, and a lowered position that is adjustable with respect to the at rest position according to the movement of said plate in a corresponding direction.

2. A device as in claim 1 wherein said elastic means are constituted by at least two springs, each of which is on one side attached to the corresponding slide, and on the other side to said plate at a point which enables its elongation to increase as a result of said slide's lower extremity sliding down said inclined surface of said corresponding track.

3. A device as in claim 1, wherein said motorizing means of said plate are constituted by a rack, formed in said plate, that engages with a pinion made to rotate, in both directions.

4. A device as in claim 3, said rack is formed in the upper part of said plate, in a position between said inclined surfaces of said traces.

* * * * *